United States Patent [19]

Venegas

[11] Patent Number: 5,030,378

[45] Date of Patent: Jul. 9, 1991

[54] LIQUID DETERGENTS CONTAINING ANIONIC SURFACTANT, BUILDER AND PROTEOLYTIC ENZYME

[75] Inventor: Manuel G. Venegas, Cincinnati, Ohio

[73] Assignee: The Procter & Gamble Company, Cincinnati, Ohio

[21] Appl. No.: 563,884

[22] Filed: Aug. 6, 1990

Related U.S. Application Data

[63] Continuation of Ser. No. 462,961, Jan. 2, 1990, abandoned, which is a continuation of Ser. No. 361,800, May 30, 1989, abandoned, which is a continuation of Ser. No. 253,309, Sep. 30, 1988, abandoned, which is a continuation of Ser. No. 110,078, Oct. 13, 1987, abandoned, which is a continuation of Ser. No. 9,641, Jan. 27, 1987, abandoned, which is a continuation of Ser. No. 723,105, Apr. 15, 1986, abandoned.

[51] Int. Cl.[5] ..... C11D 1/12; C11D 3/386

[52] U.S. Cl. ..... 252/174.12; 252/DIG. 12; 252/550; 252/553; 435/263; 435/264

[58] Field of Search ..... 252/174.12, DIG. 12; 435/263, 264

[56] References Cited

U.S. PATENT DOCUMENTS

| | | | |
|---|---|---|---|
| 3,557,002 | 1/1971 | McCarty | 252/89 |
| 3,558,498 | 1/1971 | Eymery et al. | 252/135 |
| 3,560,392 | 2/1971 | Eymery et al. | 252/138 |
| 3,623,957 | 11/1971 | Feldman | 195/66 R |
| 3,749,671 | 7/1973 | Gedge | 252/89 |
| 3,790,482 | 2/1974 | Jones et al. | 252/525 |
| 3,985,686 | 10/1976 | Barrat | 252/547 |
| 4,011,169 | 3/1977 | Diehl et al. | 252/95 |
| 4,090,973 | 5/1978 | Maguire et al. | 252/89 R |
| 4,111,855 | 9/1978 | Barrat et al. | 252/545 |
| 4,142,999 | 3/1979 | Bloching et al. | 252/544 |
| 4,242,219 | 12/1980 | Bogerman et al. | 252/174.12 |
| 4,243,543 | 1/1981 | Guilbert et al. | 252/105 |
| 4,261,868 | 4/1981 | Hora et al. | 252/529 |
| 4,318,818 | 3/1982 | Letton et al. | 252/174.12 |
| 4,381,247 | 4/1983 | Nakagawa et al. | 252/95 |
| 4,404,115 | 9/1983 | Tai | 252/135 |
| 4,404,128 | 9/1983 | Anderson | 252/546 |
| 4,507,219 | 3/1985 | Hughes | 252/118 |
| 4,529,525 | 7/1985 | Dormal | 252/132 |
| 4,537,706 | 8/1985 | Severson | 252/545 |
| 4,537,707 | 8/1985 | Severson | 252/545 |
| 4,561,998 | 12/1985 | Wertz et al. | 252/547 |
| 4,652,394 | 3/1987 | Inamorato et al. | 252/174.12 |
| 4,771,003 | 9/1988 | Stellwag et al. | 435/221 |

FOREIGN PATENT DOCUMENTS 130756 1/1985 European Pat. Off. .

OTHER PUBLICATIONS

U.S. patent application Ser. No. 609,944, Severson, filed 5-14-84.

U.S. patent application Ser. No. 723,103, Venegas, filed 4-15-85.

U.S. patent application Ser. No. 609,945, Severson, filed 5-14-84.

*Primary Examiner*—Paul Lieberman

*Assistant Examiner*—Cynthia Leslie

*Attorney, Agent, or Firm*—Donald E. Hasse; Thomas H. O'Flaherty; Richard C. Witte

[57] ABSTRACT

Heavy-duty liquid laundry detergents containing anionic synthetic surfactant, detergency builder, specific proteolytic enzyme, and calcium ion are disclosed. The compositions provide improved cleaning performance, particularly through-the-wash, on enzyme-sensitive stains.

11 Claims, No Drawings

LIQUID DETERGENTS CONTAINING ANIONIC SURFACTANT, BUILDER AND PROTEOLYTIC ENZYME

This is a continuation of application Ser. No. 462,961, filed on Jan. 2, 1990, now abandoned, which is a continuation of Ser. No. 07/361,800, filed on May 30, 1989, now abandoned, which is a continuation of Ser. No. 07/253,309, filed on Sept. 30, 1988, now abandoned, which is a continuation of Ser. No. 07/110,078, filed on Oct. 13, 1987, now abandoned, which is a continuation of Ser. No. 07/009,641, filed on Jan. 27, 1987, now abandoned, which is a continuation of Ser. No. 07/723,105, filed on Apr. 15, 1986, also now abandoned.

TECHNICAL FIELD

The present invention relates to heavy-duty liquid laundry detergent compositions containing anionic synthetic surfactant, detergency builder, specific proteolytic enzyme and calcium ion. The compositions provide improved cleaning performance, particularly through-the-wash, of enzyme-sensitive stains such as grass, blood, gravy and chocolate pudding.

Laundry detergents containing high levels of anionic surfactant and builder, and capable of providing superior cleaning performance, are currently available. Some of these compositions also contain enzymes to enhance removal of enzyme-sensitive stains. However, it is believed that such compositions are enzyme-limited in that they can denature and expose stains to enzymatic action faster than currently available enzymes can cleave and break up the stains.

Enzyme performance can also be limited by a lack of adequate stability in liquid detergents. The stabilization of enzymes is particularly difficult in built, heavy-duty liquid detergents containing high levels of anionic surfactant and water. Anionic surfactants, especially alkyl sulfates, tend to denature enzymes and render them inactive. Detergent builders can sequester the calcium ion needed for enzyme activity and/or stability.

Thus, there is a continuing need for the development of new enzymes that provide improved performance and better stability in liquid detergent compositions, particularly those containing high levels of anionic surfactant and builder.

BACKGROUND ART

U.S. Pat. No. 4,261,868, Hora et al., issued Apr. 14, 1981, discloses liquid detergents containing enzymes and, as an enzyme-stabilizing system, 2–25% of a polyfunctional amino compound selected from diethanolamine, triethanolamine, di-isopropanolamine, triisopropanolamine and tris(hydroxymethyl) aminomethane, and 0.25–15% of a boron compound selected from boric acid, boric oxide, borax, and sodium ortho-, meta- and pyroborate. The compositions can contain 10–60% surfactant, including anionics, and up to 40% builder.

U.S. Pat. No. 4,404,115, Tai, issued Sept. 13, 1983, discloses liquid cleaning compositions, preferably built liquid detergents, containing enzyme, 1–15% alkali metal pentaborate, 0–15% alkali metal sulfite, and 0–15% of a polyol having 2–6 hydroxy groups. The compositions can contain 1–60% surfactant, preferably a mixture of anionic and nonionic in a weight ratio of 6:1 to 1:1, with or without soap. The compositions also preferably contain 5–50% builder.

U.S. Pat. No. 4,318,818, Letton et al., issued Mar. 9, 1982, discloses liquid detergents containing enzymes and an enzyme-stabilizing system comprising calcium ion and a low molecular weight carboxylic acid or salt, preferably a formate. The compositions preferably contain from about 20% to 50% surfactant, which can be anionic. In a preferred embodiment, the compositions contain about 3% to 15% of a saturated fatty acid. They are otherwise substantially free of builders, but can contain minor amounts of sequestrants.

European Patent Application 130,756, published Jan. 9, 1985, discloses the proteolytic enzymes herein and methods for their preparation. The enzymes are said to be useful in laundry detergents, both liquid and granular. They can be combined with surfactants (including anionics), builders, bleach and/or fluorescent whitening agents, but there is no disclosure of specific detergent compositions.

SUMMARY OF THE INVENTION

This invention relates to heavy-duty liquid laundry detergent compositions comprising, by weight:

(a) from about 7% to about 50% of an anionic synthetic surfactant;

(b) from about 5% to about 40% of a detergency builder;

(c) from about 0.01% to about 5% of the proteolytic enzyme characterized by the following amino acid sequence:

```
1                                   10
Ala Gln Ser Val Pro Tyr Gly Val Ser Gln Ile Lys Ala Pro

                20
Ala Leu His Ser Gln Gly Tyr Thr Gly Ser Asn Val Lys Val

    30                                      40
Ala Val Ile Asp Ser Gly Ile Asp Ser Ser His Pro Asp Leu

                            50
Lys Val Ala Gly Gly Ala Ser Met Val Pro Ser Glu Thr Asn

            60                                      70
Pro Phe Gln Asp Asn Asn Ser His Gly Thr His Val Ala Gly

                                        80
Thr Val Ala Ala Leu Asn Asn Ser Ile Gly Val Leu Gly Val

                    90
Ala Pro Ser Ala Ser Leu Tyr Ala Val Lys Val Leu Gly Ala

    100                                     110
Asp Gly Ser Gly Gln Tyr Ser Trp Ile Ile Asn Gly Ile Glu

                            120
Trp Ala Ile Ala Asn Asn Met Asp Val Ile Asn Met Ser Leu

            130                                     140
Gly Gly Pro Ser Gly Ser Ala Ala Leu Lys Ala Ala Val Asp

                                        150
Lys Ala Val Ala Ser Gly Val Val Val Val Ala Ala Ala Gly

                    160
Asn Glu Gly Thr Ser Gly Ser Ser Ser Thr Val Gly Tyr Pro

    170                                     180
Gly Lys Tyr Pro Ser Val Ile Ala Val Gly Ala Val Asp Ser

                            190
Ser Asn Gln Arg Ala Ser Phe Ser Ser Val Gly Pro Glu Leu

            200                                     210
Asp Val Met Ala Pro Gly Val Ser Ile Gln Ser Thr Leu Pro
```

-continued

220
Gly Asn Lys Tyr Gly Ala Tyr Asn Gly Thr Ser Met Ala Ser

230
Pro His Val Ala Gly Ala Ala Ala Leu Ile Leu Ser Lys His 240 250
Pro Asn Trp Thr Asn Thr Gln Val Arg Ser Ser Leu Glu Asn

260
Thr Thr Thr Lys Leu Gly Asp Ser Phe Tyr Tyr Gly Lys Gly 270 275
Leu Ile Asn Val Gln Ala Ala Ala Gln, (hereinafter referred to as Protease A); or wherein the Gly at position 166 is replaced with Asn, Ser, Lys, Arg, His, Gln, Ala or Glu; the Gly at position 169 is replaced with Ser; the Met at position 222 is replaced with Gln, Phe, Cys, His, Asn, Glu, Ala or Thr; the Gly at position 166 is replaced with Lys and the Met at position 222 is replaced with Cys; or the Gly at position 169 is replaced with Ala and the Met at position 222 is replaced with Ala;

(d) from about 0.01 to about 50 millimoles of calcium ion per liter of composition; and (e) from about 10% to about 80% of water; said composition containing at least about 20% of (a)+(b) and having an initial pH of from about 6.5 to about 9.5 at a concentration of about 0.2% in water at 20° C.

DETAILED DESCRIPTION OF THE INVENTION

The liquid detergents of the present invention contain, as essential components, anionic synthetic surfactant, detergency builder, specific proteolytic enzyme, calcium ion, and water. The compositions herein provide improved cleaning performance, particularly through-the-wash, on enzyme-sensitive stains such as grass, blood, gravy and chocolate pudding.

While not intending to be limited by theory, it is believed that the relatively high level of anionic surfactant and builder in the present compositions provides an effective matrix for denaturing stains and exposing sites to enzymatic action. The anionic surfactant is believed to be the primary denaturing agent, whereas the builder controls water hardness that would otherwise complex the anionic surfactant and interfere with its denaturing action. Once the stains are denatured, enzymes bind to the exposed sites and clip chemical bonds before returning to solution to begin the cycle again. After a sufficient number of clips are made, the stained fragments are removed and/or solubilized by the surfactants. However, it is believed that the surfactant and builder matrix herein can denature and expose more sites on stains than currently available enzymes can cleave during the washing process. This is particularly true at low washing temperatures (e.g., in the range of 15° C. to 35° C.) where enzymes are catalytically slow. The present proteolytic enzymes appear to be superior to other proteases in catalytic efficiency. They thus can take advantage of the stain denaturing power of the compositions herein and provide significant stain removal benefits. In contrast, they provide little or no benefits in detergent compositions containing less anionic surfactant and builder.

ANIONIC SYNTHETIC SURFACTANT

The compositions of the present invention contain from about 7% to about 50%, preferably from about 10% to about 40%, and most preferably from about 15% to about 30%, by weight of an anionic synthetic surfactant. Suitable anionic synthetic surfactants are disclosed in U.S. Pat. No. 4,285,841, Barrat et al., issued Aug. 25, 1981, and in U.S. Pat. No. 3,929,678, Laughlin et al., issued Dec. 30, 1975, both incorporated herein by reference.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil; and the alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 14.

Other anionic surfactants herein are the water-soluble salts of: paraffin sulfonates containing from about 8 to about 24 (preferably about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy- alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Preferred anionic surfactants are the $C_{10}$–$C_{18}$ alkyl sulfates and alkyl ethoxy sulfates containing an average of up to about 4 ethylene oxide units per mole of alkyl sulfate, $C_{11}$–$C_{13}$ linear alkylbenzene sulfonates, and mixtures thereof.

The compositions preferably contain from about 1% to about 5%, more preferably from about 2% to about 4%, by weight of unethoxylated alkyl sulfate. These alkyl sulfates are desired for best detergency performance, in part because they are very denaturing to stains.

The compositions herein can optionally contain other synthetic surfactants known in the art, such as the nonionic, cationic, zwitterionic, and ampholytic surfactants described in the above-cited Barrat et al. and Laughlin et al. patents.

A preferred cosurfactant, used at a level of from about 1% to about 25%, preferably from about 3% to about 15%, by weight of the composition, is an ethoxylated nonionic surfactant of the formula $R^1(OC_2H_4)_nOH$, wherein $R^1$ is a $C_{10}$–$C_{16}$ alkyl group or a $C_8$–$C_{12}$ alkyl phenyl group, n is from about 3 to about 9, and said nonionic surfactant has an HLB (hydrophile-lipophile balance) of from about 6 to about 14, preferably from about 10 to about 13. These surfactants are more fully described in U.S. Pat. Nos. 4,285,841, Barrat et al., issued Aug. 25, 1981, and 4,284,532, Leikhim et al., issued Aug. 18, 1981, both incorporated herein by reference. Particularly preferred are condensation products of $C_{12}$–$C_{15}$ alcohols with from about 3 to about 8 moles of ethylene oxide per mole of alcohol, e.g., $C_{12}$–$C_{13}$ alcohol condensed with about 6.5 moles of ethylene oxide per mole of alcohol.

Preferred cosurfactants for use with the above ethoxylated nonionic surfactants are amides of the formula

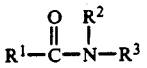

wherein $R^1$ is an alkyl, hydroxyalkyl or alkenyl radical containing from about 8 to about 20 carbon atoms, and $R^2$ and $R^3$ are selected from the group consisting of hydrogen, methyl, ethyl, propyl, isopropyl, 2-hydroxyethyl, 2-hydroxypropyl, 3-hydroxypropyl, and said radicals additionally containing up to about 5 ethylene oxide units, provided at least one of $R^2$ and $R^3$ contains a hydroxyl group.

Preferred amides are the $C_8$–$C_{20}$ fatty acid alkylol amides in which each alkylol group contains from 1 to 3 carbon atoms, and additionally can contain up to about 2 ethylene oxide units. Particularly preferred are the $C_{12}$–$C_{16}$ fatty acid monoethanol and diethanol amides.

Certain compositions herein preferably contain from about 5% to about 20%, preferably from about 6% to about 15%, more preferably from about 7% to about 12%, by weight of a mixture of the above ethoxylated nonionic surfactant and amide surfactant in a weight ratio of from about 4:1 to 1:4, preferably from about 3:1 to about 1:3, more preferably from about 2:1 to about 1:2. In addition, the weight ratio of anionic synthetic surfactant (on an acid basis) to the total nonionic surfactant (both the ethoxylated nonionic and the amide) should be from about 2:1 to about 4:1, preferably from about 2.5:1 to about 3.5:1, to ensure the formation and adsorption of sufficient hardness surfactants at the oil/water interface to provide good greasy/oily soil removal.

Other preferred cosurfactants, used at a level of from about 0.5% to about 3%, preferably from about 0.7% to about 2%, by weight are the quaternary ammonium, amine or amine oxide surfactants described in U.S. Pat. No. 4,507,219, Hughes, issued Mar. 26, 1985, incorporated herein by reference.

While the compositions herein can contain di-long chain quaternary ammonium cationic surfactants (e.g., those having 2 chains, each containing an average of from about 16 to about 22 carbon atoms), such as disclosed in British Patent 2,041,968, Murphy, published Sept. 19, 1979, incorporated herein by reference, the compositions preferably contain less than about 2%, more preferably less than about 1%, by weight of such surfactants. Most preferably, the compositions are substantially free of such surfactants because they appear to be detrimental to the stability of the proteolytic enzymes herein.

DETERGENCY BUILDER

The compositions herein contain from about 5% to about 40%, preferably from about 8% to about 30%, more preferably from about 10% to about 25%, by weight of a detergent builder material. In addition, the composition should contain at least about 20%, preferably from about 25% to about 60%, more preferably from about 30% to about 50%, by weight of the anionic synthetic surfactant and builder. Since the proteolytic enzymes herein appear to provide optimum performance benefits versus other enzymes when the builder to water hardness ratio is close to one, the compositions preferably contain sufficient builder to sequester from about 2 to about 10, preferably from about 3 to about 8, grains per gallon of hardness.

Useful builders are fatty acids containing from about 10 to about 22 carbon atoms. Preferred are saturated fatty acids containing from about 10 to about 18, preferably from about 10 to about 14, carbon atoms. When present, the fatty acid preferably represents about 5% to about 20%, more preferably from about 8% to about 16%, by weight of the composition.

Suitable saturated fatty acids can be obtained from natural sources such as plant or animal esters (e.g., palm kernel oil, palm oil and coconut oil) or synthetically prepared (e.g., via the oxidation of petroleum or by hydrogenation of carbon monoxide via the Fisher-Tropsch process). Examples of suitable saturated fatty acids for use in the compositions of this invention include capric, lauric, myristic, coconut and palm kernel fatty acid. Preferred are saturated coconut fatty acids; from about 5:1 to 1:1 (preferably about 3:1) weight ratio mixtures of lauric and myristic acid; mixtures of the above with minor amounts (e.g., 1%–30% of total fatty acid) of oleic acid; and palm kernel fatty acid.

Detergent builders useful herein also include the polycarboxylate, polyphosphonate and polyphosphate builders described in U.S. Pat. No. 4,284,532, Leikhim et al., issued Aug. 18, 1981, incorporated herein by reference. Water-soluble polycarboxylate builders, particularly citrates, are preferred of this group. Polycarboxylate builders preferably represent from about 1% to about 20% by weight of the composition.

Suitable polycarboxylate builders include the various aminopolycarboxylates, cycloalkane polycarboxylates, ether polycarboxylates, alkyl polycarboxylates, epoxy polycarboxylates, tetrahydrofuran polycarboxylates, benzene polycarboxylates, and polyacetal polycarboxylates.

Examples of such polycarboxylate builders are sodium and potassium ethylenediaminetetraacetate; sodium and potassium nitrilotriacetate; the water-soluble salts of phytic acid, e.g., sodium and potassium phytates, disclosed in U.S. Pat. No. 1,739,942, Eckey, issued Mar. 27, 1956, incorporated herein by reference; the polycarboxylate materials described in U.S. Pat. No. 3,364,103, incorporated herein by reference; and the water-soluble salts of polycarboxylate polymers and copolymers described in U.S. Pat. No. 3,308,067, Diehl, issued Mar. 7, 1967, incorporated herein by reference.

Useful detergent builders also include the water-soluble salts of polymeric aliphatic polycarboxylic acids having the following structural and physical characteristics: (a) a minimum molecular weight of about 350 calculated as to the acid form; (b) an equivalent weight of about 50 to about 80 calculated as to acid form; (3) at least 45 mole percent of the monomeric species having at least two carboxyl radicals separated from each other by not more than two carbon atoms: (d) the site of attachment of the polymer chain of any carboxyl-containing radical being separated by not more than three carbon atoms along the polymer chain from the site of attachment of the next carboxyl-containing radical. Specific examples of such builders are the polymers and copolymers of itaconic acid, aconitic acid, maleic acid, mesaconic acid, fumaric acid, methylene malonic acid, and citraconic acid.

Other suitable polycarboxylate builders include the water-soluble salts, especially the sodium and potassium salts, of mellitic acid, citric acid, pyromellitic acid, benzene pentacarboxylic acid, oxydiacetic acid, carboxymethyloxysuccinic acid, carboxymethyloxymalonic acid, cis-cyclohexanehexacarboxylic acid, cis-cyclopentanetetracarboxylic acid and oxydisuccinic acid.

Other polycarboxylates for use herein are the polyacetal carboxylates described in U.S. Pat. Nos. 4,144,226, issued Mar. 13, 1979 to Crutchfield et al., and 4,146,495, issued Mar. 27, 1979 to Crutchfield et al., both incorporated herein by reference.

Other detergent builders useful herein include the aluminosilicate ion exchange material described in U.S. Pat. No. 4,405,483, Kuzel et al., issued Sept. 20, 1983, incorporated herein by reference.

As part of the builder system, the compositions herein preferably contain from about 0.1% to about 1%, more preferably from about 0.2% to about 0.6%, by weight of water-soluble salts of ethylenediamine tetramethylenephosphonic acid, diethylenetriamine pentamethylenephosphonic acid, ethylenediamine tetraacetic acid, or diethylenetriamine pentaacetic acid to enhance cleaning performance when pretreating fabrics.

PROTEOLYTIC ENZYME

The compositions of the present invention contain from about 0.01% to about 5%, preferably from about 0.1% to about 2%, by weight of the composition of Protease A as previously defined, or variants thereof in which the Gly at position 166 is replaced with Asn, Ser, Lys, Arg, His, Gln, Ala or Glu; the Gly at position 169 is replaced with Ser; the Met at position 222 is replaced with Gln, Phe, Cys, His, Asn, Glu, Ala or Thr; the Gly at position 166 is replaced with Lys and the Met at position 222 is replaced with Cys; or the Gly at position 169 is replaced with Ala and the Met at position 222 is replaced with Ala.

These proteases, andly at position 169 is replaced with Ala and the Met at position 222 is replaced with Ala.

These proteases, and methods for their preparation, are described in European Patent Application 130,756, published Jan. 9, 1985, incorporated herein by reference.

The above enzyme is preferably included in an amount sufficient to provide an activity of from about 0.001 to about 0.1, more preferably from about 0.005 to about 0.07, most preferably from about 0.01 to about 0.04, Anson units per gram of composition.

The proteases herein are preferably purified, prior to incorporation in the finished composition, so that they have no detectable odor at a concentration of less than about 0.002 Anson units per gram in distilled water. They preferably have no detectable odor at a concentration of less than about 0.0025, more preferably less than about 0.003, Anson units per gram of distilled water.

Proteases herein can be odor purified by any method known in the art. Examples include the solvent precipitation methods described in *Precipitation of the Enzymes and Their Stability in High Alcohol Concentrations* by Bauer et al. in the Israel J. Chem. 5(3), pages 117–20 (1967) and *Enzyme Preparations* by Sugiura et al. and Yakusaigaku 1967, Volume 27(2), pages 135–9.

Solvent initiated precipitation of a crude commercial enzyme solution results in most of the enzymatic activity being precipitated from solution and most of the odor and color impurities remaining in the supernatant liquid. Decantation or centrifugation of the supernatant liquid from the precipitated enzyme results in an enzyme fraction with enriched enzymatic activity/gram and improved odor and color.

Various solvents or solvent pair combinations can be used to effect the desired precipitation. For example, methanol, ethanol, acetone, other organic solvents, and combinations of organic solvents with and without water can be used. A highly preferred solvent is a combination of water and 30–70% by weight ethanol. This appears to be optimal to prevent enzyme deactivation and maximum recovery of activity.

Purification of protease enzymes also provide benefits in the area of product color stability.

CALCIUM ION

The composition also contains from about 0.01 to about 50, preferably from about 0.1 to about 30, more preferably from about 1 to about 20, millimoles of calcium ion per liter. The level of calcium ion should be selected so that there is always some minimum level available for the enzyme, after allowing for complexation with builders, etc., in the composition. Any water-soluble calcium salt can be used as the source of calcium ion, including calcium chloride, calcium formate, and calcium acetate. A small amount of calcium ion, generally from about 0.05 to about 0.4 millimoles per liter, is often also present in the composition due to calcium in the enzyme slurry and formula water.

WATER

Finally, the compositions herein contain from about 10% to about 80%, preferably from about 20% to about 60%, more preferably from about 30% to about 50%, by weight of water.

OPTIONAL COMPONENTS

The compositions of the present invention can also contain other materials known in the art to enhance enzyme stability. Preferably the compositions herein contain from about 0.1% to about 10%, more preferably from about 0.25% to about 5%, most preferably from about 0.5% to about 3%, by weight of boric acid or a compound capable of forming boric acid in the composition (calculated on the basis of the boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Other preferred enzyme stabilizers are polyols containing only carbon, hydrogen and oxygen atoms. They preferably contain from 2 to 6 carbon atoms and from 2 to 6 hydroxy groups. Examples include propylene glycol (especially 1,2 propane diol, which is preferred), ethylene glycol, glycerol, sorbitol, mannitol, and glucose. The polyol generally represents from about 1% to about 15%, preferably from about 1.5% to about 10%, by weight of the composition. Preferably, the weight ratio of polyol to boric acid is at least 1, more preferably at least about 1.3.

The compositions can also contain the water-soluble, short chain carboxylates described in U.S. Pat. No. 4,318,818, Letton et al., issued Mar. 9, 1982, incorporated herein by reference. The formates are preferred and can be used at levels of from about 0.05% to about 5%, preferably from about 0.2% to about 2%, most preferably from about 0.4% to about 1.5%, by weight of the composition.

The compositions herein have an initial pH of from about 6.5 to about 9.5, preferably from about 7 to about 8.5, most preferably from about 7.2 to about 8.0, at a concentration of 0.2% by weight in distilled water at 20° C. Preferred pH buffers include monoethanolamine and triethanolamine. Monoethanolamine and triethanolamine also further enhance enzyme stability, and preferably are included at levels of from about 0.5% to about 10%, preferably from about 1% to about 4%, by weight of the composition.

Other optional components for use in the liquid detergents herein include soil removal agents, anti-redeposition agents, suds regulants, hydrotropes, opacifiers, antioxidants, bactericides, dyes, perfumes, and brighteners known in the art. Such optional components generally represent less than about 15%, preferably from about 1% to about 10%, by weight of the composition.

Particularly preferred stable isotropic liquid detergents herein are described in U.S. Pat. No. 4,507,219, Hughes, issued Mar. 26, 1985, incorporated herein by reference.

The following examples illustrate the compositions of the present invention.

All parts, percentages and ratios used herein are by weight unless otherwise specified.

EXAMPLE I

The following detergent compositions were prepared.

| Component | Wt. % | | | | |
|---|---|---|---|---|---|
| | A | B | C | D | E |
| $C_{13}$ linear alkylbenzene sulfonic acid | 7.2 | 8.0 | — | — | 8.0 |
| $C_{14-15}$ alkyl polyethoxylate (2.25) sulfuric acid | 10.8 | 12.0 | — | — | 12.0 |
| $C_{12-14}$ alkyl polyethoxylate (1) sulfuric acid | — | — | 8.8 | — | |
| (Alkyl sulfuric acid) | (2.5) | (2.8) | (3.9) | — | (2.8) |
| $C_{12-13}$ alcohol polyethoxylate (6.5) | 6.5* | 5.0* | 21.5 | — | 5.0* |
| $C_{14-15}$ alcohol polyethoxylate (7)* | — | — | — | 18.0 | — |
| $C_{12}$ alkyl trimethylammonium chloride | 1.2 | 0.6 | — | — | 0.6 |

-continued

| Component | Wt. % | | | | |
|---|---|---|---|---|---|
| | A | B | C | D | E |
| Ditallowalkyl dimethyl ammonium chloride | — | — | — | 3.6 | — |
| $C_{12-14}$ alkyl dimethyl amine oxide | — | — | — | 4.0 | — |
| $C_{12-14}$ fatty acid | 13.0 | 10.0 | — | — | 7.7 |
| Palm kernel fatty acid | — | — | — | — | 3.3 |
| Oleic acid | 2.0 | 0.5 | — | — | 2.0 |
| Citric acid (anhydrous) | 4.0 | 4.0 | — | — | 4.0 |
| Sodium diethylenetriamine pentaacetate | 0.3 | 0.3 | — | — | 0.3 |
| Protease enzyme | As indicated | | | | |
| Amylase enzyme (325 Am. U/g) | — | — | — | — | 0.16 |
| TEPA-$E_{15-18}$** | 1.5 | 2.0 | — | — | 2.0 |
| Soil release compound**** | — | — | — | — | 2.5 |
| Monoethanolamine | 2.0 | 2.0 | — | — | 1.0 |
| Sodium hydroxide | 1.7 | 4.0 | — | — | 2.0 |
| Potassium hydroxide | 4.0 | 1.6 | — | — | 5.4 |
| 1,2 Propane diol | 7.25 | 4.0 | — | — | 6.5 |
| Ethanol | 7.75 | 8.5 | 5.7 | 7.5 | 7.0 |
| Sodium formate | 1.0 | 1.0 | 1.6 | — | 1.0 |
| Total calcium ion*** (mm/1) | 9.65 | 9.65 | 0.25 | 0.25 | 9.65 |
| Minors and water | Balance to 100 | | | | |
| Initial pH of 0.2% solution in distilled water at 20° C. | 7.5 | 7.5 | 7.2 | 7.2 | 7.5 |

*Alcohol and monoethoxylated alcohol removed.

**Tetraethylene pentaimine ethoxylated with 15-18 moles (avg.) of ethylene oxide at each hydrogen site.

***Includes estimated 0.25 millimoles of calcium ion per liter from enzyme slurry and formula water.

****A compound having a range of copolymers of the formula:

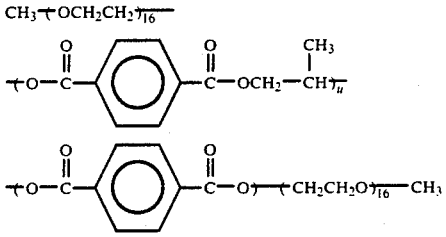

in which about 20% by weight of the material has a value of u higher than 5 is dissolved about 15% level in anhydrous ethanol; cooled to about 10° C.; the insoluble portion (~20%) is filtered; and enough ethanol is distilled to reduce the ethanol level to within the level in the formula When used in Compositions A and B (which were tested at a concentration of 2000 parts per million [ppm] in water), Protease A of the present invention provided significantly better through-the-wash cleaning of enzyme-sensitive stains such as grass, blood, gravy, and/or chocolate pudding than did equivalent amounts (providing either 0.0012, 0.015 or 0.03 Anson units of activity per gram of composition) of the commercially available proteolytic enzymes Alcalase ® (Novo Industries A.S.), Maxatase ® (Gist-Brocades N.V.) and Maxacal ® (Gist-Brocades N.V.). With pretreatment, Protease A provided smaller, generally directional benefits, but with some losses, versus Alcalase on enzyme-sensitive stains. Protease A also provided similar benefits relative to Alcalase when the pH of Composition A in the wash solution was adjusted from 7.5 to 7.1, 7.3, 8.0 and 8.5. Protease A provided similar benefits relative to Maxatase when the pH of Composition B in the wash solution was adjusted to 8.0 and 8.5. Significant advantages on grass and chocolate pudding for Protease A were also obtained when the solution pH of Composition B was adjusted to 9.0 and 9.5, although the magnitude of the benefit was reduced at these higher pH's.

In Compositions C (which was tested at a concentration of 900 ppm in water) and D (tested at a concentration of 2000 ppm in water), both of which are not within the scope of the invention, Protease A exhibited little or no benefit overall, and some negatives, on enzyme-sensitive stains, both through-the-wash and with pretreatment, when compared with Alcalase.

Protease A was also significantly less effective than Maxacal on certain grass, blood, gravy and chocolate pudding stains when used in a granular detergent (which is not within the scope of the invention) containing 14.5% anionic surfactant, 33.7% sodium tripolyphosphate and 10.5% sodium carbonate builder, and which provided a pH of 10.0 at its usage concentration of 1500 ppm by weight in water at 20° C. Protease A was generally equivalent to Alcalase in the same test, except for significant advantages on some blood stains. When the solution pH of the granular detergent was reduced to 8.0 and 8.5, Protease A was significantly less effective than Maxatase on grass, blood, gravy and chocolate pudding stains.

When the $C_{12-14}$ fatty acid and citric acid of Composition A were added at a level of 260 ppm and 80 ppm, respectively, to wash water containing 900 ppm of Composition C (thereby providing a composition which would have been within the scope of the invention if the fatty acid and citric acid were added directly to Composition C), Protease A provided better overall cleaning and significant advantages on some stains when compared with Alcalase. Similar results were obtained when 260 ppm of the fatty acid and 60 ppm of citric acid were added to a wash solution containing 1800 ppm of Composition C (also thereby providing a composition which would have been within the scope of the invention if the acids were added directly to Composition C).

Variants of Protease A in which the Gly at position 166 is replaced with Asn, Ser, Lys, Arg, His, Gln, Ala or Glu; the Gly at position 169 is replaced with Ser; the Met at position 222 is replaced with Gln, Phe, Cys, His, Asn, Glu, Ala or Thr; the Gly at position 166 is replaced with Lys and the Met at position 222 is replaced with Cys; or the Gly at position 169 is replaced with Ala and the Met at position 222 is replaced with Ala, all provided better stain removal than Alcalase when tested in Composition A.

Preferred Composition E of the present invention contains 0.75% of a slurry of Protease A, providing an activity of 0.015 Anson units per gram of composition.

What is claimed is:

1. A heavy-duty liquid laundry detergent composition comprising, by weight:

(a) from about 7% to about 50% of an anionic synthetic surfactant which comprises a $C_{10}$–$C_{18}$ alkyl sulfate, a $C_{10}$–$C_{18}$ alkyl ethoxy sulfate containing an average of up to about 4 moles of ethylene oxide per mole of alkyl sulfate, a $C_{11}$–$C_{13}$ linear alkylbenzene sulfonate, or mixtures thereof;

(b) a detergency builder comprising a mixture of from about 5% to about 20% of a saturated fatty acid containing from about 10 to about 14 carbon atoms and from about 1% to about 20% of a water-soluble polycarboxylate builder;

(c) from about 0.01% to about 5% of the proteolytic enzyme characterized by the following amino acid sequence:

```
1                                   10
Ala Gln Ser Val Pro Tyr Gly Val Ser Gln Ile Lys Ala Pro

                    20
Ala Leu His Ser Gln Gly Tyr Thr Gly Ser Asn Val Lys Val
```

-continued

```
30                                  40
Ala Val Ile Asp Ser Gly Ile Asp Ser Ser His Pro Asp Leu

                    50
Lys Val Ala Gly Gly Ala Ser Met Val Pro Ser Glu Thr Asn

        60                                          70
Pro Phe Gln Asp Asn Asn Ser His Gly Thr His Val Ala Gly

                    80
Thr Val Ala Ala Leu Asn Asn Ser Ile Gly Val Leu Gly Val

                90
Ala Pro Ser Ala Ser Leu Tyr Ala Val Lys Val Leu Gly Ala

100                                         110
Asp Gly Ser Gly Gln Tyr Ser Trp Ile Ile Asn Gly Ile Glu

                    120
Trp Ala Ile Ala Asn Asn Met Asp Val Ile Asn Met Ser Leu

        130                                         140
Gly Gly Pro Ser Gly Ser Ala Ala Leu Lys Ala Ala Val Asp

                    150
Lys Ala Val Ala Ser Gly Val Val Val Val Ala Ala Ala Gly

                160
Asn Glu Gly Thr Ser Gly Ser Ser Ser Thr Val Gly Tyr Pro

170                                         180
Gly Lys Tyr Pro Ser Val Ile Ala Val Gly Ala Val Asp Ser

                    190
Ser Asn Gln Arg Ala Ser Phe Ser Ser Val Gly Pro Glu Leu

        200                                         210
Asp Val Met Ala Pro Gly Val Ser Ile Gln Ser Thr Leu Pro

                    220
Gly Asn Lys Tyr Gly Ala Tyr Asn Gly Thr Ser Met Ala Ser

                230
Pro His Val Ala Gly Ala Ala Ala Leu Ile Leu Ser Lys His

240                                         250
Pro Asn Trp Thr Asn Thr Gln Val Arg Ser Ser Leu Glu Asn

                    260
Thr Thr Thr Lys Leu Gly Asp Ser Phe Tyr Tyr Gly Lys Gly

        270                 275
Leu Ile Asn Val Gln Ala Ala Ala Gln;
```

or wherein the Gly at position 166 is replaced with Asn, Ser, Lys, Arg, His, Gln, Ala or Glu; the Gly at position 169 is replaced with Ser; the Met at position 222 is replaced with Gln, Phe, Cys, His, Asn, Glu, Ala or Thr; the Gly at position 166 is replaced with Lys and the Met at position 222 is replaced with Cys; or the Gly at position 169 is replaced with Ala and the Met at position 222 is replaced with Ala;

(d) from about 0.01 to about 50 millimoles of calcium ion per liter of composition; and (e) from about 10% to about 80% of water; said composition containing at least about 20% of (a)+(b) and having an initial pH of from about 6.5 to about 9.5 at a concentration of 0.2% in water at 20° C.

2. A composition according to claim 1 comprising from about 15% to about 30% of the anionic synthetic surfactant.

3. A composition according to claim 2 comprising from about 1% to about 5% of an unethoxylated $C_{10}$–$C_{18}$ alkyl sulfate surfactant.

4. A composition according to claim 2 wherein the polycarboxylate builder comprises citrate.

5. A composition according to claim 4 comprising from about 0.01% to about 1% of a water-soluble salt of ethylenediamine tetramethylenephosphonic acid, diethylenetriamine pentamethylenephosphonic acid, ethylenediamine tetraacetic acid, or diethyelenetriamine pentaacetic acid.

6. A composition according to claim 1 comprising from about 30% to about 50% of the anionic synthetic surfactant and detergency builder.

7. A composition according to claim 6 comprising from about 15% to about 30% of the anionic synthetic surfactant.

8. A composition according to claim 7 comprising from about 1% to about 5% of an unethoxylated $C_{10}$–$C_{18}$ alkyl sulfate surfactant.

9. A composition according claim 8 comprising from about 10% to about 25% of the detergency builder.

10. A composition according to claim 9 wherein the polycarboxylate builder comprises citrate.

11. A composition according to claim 10 wherein the proteolytic enzyme is characterized by the following amino acid sequence 1 10
Ala Gln Ser Val Pro Tyr Gly Val Ser Gln Ile Lys Ala Pro 20
Ala Leu His Ser Gln Gly Tyr Thr Gly Ser Asn Val Lys Val 30 40
Ala Val Ile Asp Ser Gly Ile Asp Ser Ser His Pro Asp Leu 50
Lys Val Ala Gly Gly Ala Ser Met Val Pro Ser Glu Thr Asn 60 70
Pro Phe Gln Asp Asn Asn Ser His Gly Thr His Val Ala Gly -continued 80
Thr Val Ala Ala Leu Asn Asn Ser Ile Gly Val Leu Gly Val 90
Ala Pro Ser Ala Ser Leu Tyr Ala Val Lys Val Leu Gly Ala 100 110
Asp Gly Ser Gly Gln Tyr Ser Trp Ile Ile Asn Gly Ile Glu 120
Trp Ala Ile Ala Asn Asn Met Asp Val Ile Asn Met Ser Leu 130 140
Gly Gly Pro Ser Gly Ser Ala Ala Leu Lys Ala Ala Val Asp 150
Lys Ala Val Ala Ser Gly Val Val Val Val Ala Ala Ala Gly 160
Asn Glu Gly Thr Ser Gly Ser Ser Ser Thr Val Gly Tyr Pro 170 180
Gly Lys Tyr Pro Ser Val Ile Ala Val Gly Ala Val Asp Ser 190
Ser Asn Gln Arg Ala Ser Phe Ser Ser Val Gly Pro Glu Leu 200 210
Asp Val Met Ala Pro Gly Val Ser Ile Gln Ser Thr Leu Pro 220
Gly Asn Lys Tyr Gly Ala Tyr Asn Gly Thr Ser Met Ala Ser 230
Pro His Val Ala Gly Ala Ala Ala Leu Ile Leu Ser Lys His 240 250
Pro Asn Trp Thr Asn Thr Gln Val Arg Ser Ser Leu Glu Asn 260
Thr Thr Thr Lys Leu Gly Asp Ser Phe Tyr Tyr Gly Lys Gly 270 275
Leu Ile Asn Val Gln Ala Ala Ala Gln

* * * * *